US010597749B2

(12) United States Patent
Kwon et al.

(10) Patent No.: US 10,597,749 B2
(45) Date of Patent: Mar. 24, 2020

(54) CONTINUOUS ANNEALING APPARATUS

(71) Applicants: HYUNDAI MOTOR COMPANY, Seoul (KR); KIA MOTORS CORPORATION, Seoul (KR)

(72) Inventors: Soon Woo Kwon, Ansan-si (KR); Min Woo Kang, Incheon (KR); Moon Ki Bae, Daegu (KR); Seung Hyun Hong, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 219 days.

(21) Appl. No.: 15/830,852

(22) Filed: Dec. 4, 2017

(65) Prior Publication Data

US 2019/0032168 A1 Jan. 31, 2019

(30) Foreign Application Priority Data

Jul. 25, 2017 (KR) ..... 10-2017-0094159

(51) Int. Cl.

| | |
|---|---|
| ***F27B 9/12*** | (2006.01) |
| ***C21D 9/56*** | (2006.01) |
| ***C21D 9/68*** | (2006.01) |
| ***C21D 9/573*** | (2006.01) |
| ***F27B 9/28*** | (2006.01) |
| ***F27B 19/04*** | (2006.01) |
| ***F27D 7/04*** | (2006.01) |
| *F27D 99/00* | (2010.01) |

(52) U.S. Cl.

CPC ..... *C21D 9/562* (2013.01); *C21D 9/5735* (2013.01); *C21D 9/68* (2013.01); *F27B 9/12* (2013.01); *F27B 9/28* (2013.01); *F27B 19/04* (2013.01); *F27D 7/04* (2013.01); *F27B 2009/122* (2013.01); *F27B 2009/124* (2013.01); *F27D 2099/0085* (2013.01)

(58) Field of Classification Search

CPC ..... C21D 9/562; F27B 19/04

See application file for complete search history.

(56) References Cited

FOREIGN PATENT DOCUMENTS

EP 2775007 A1 * 9/2014 ..... C21D 8/12
KR 10-1983-0005376 A 8/1998

* cited by examiner

*Primary Examiner* — Scott R Kastler

(74) *Attorney, Agent, or Firm* — Morgan, Lewis & Bockius LLP

(57) ABSTRACT

A continuous annealing apparatus includes: a pre-treatment device to prepare a strip unwound from a coil; a heating device to heat the strip prepared by the pre-treatment device; a heat holding device to isothermally maintain the strip heated by the heating device; a first cooling device to cool the strip heat-maintained by the heat holding device; an annealing device including a first annealing device for annealing the strip, which, is cooled by the first cooling device, for a first time, and a second annealing device for winding the strip, which is cooled by the first cooling device, into a coil and then unwinding the coil into the strip again after annealing for a second time; a second cooling device to cool the strip annealed by the first annealing device or the second annealing device; and a post-treatment device to wind the strip cooled by the second cooling device into the coil.

6 Claims, 4 Drawing Sheets

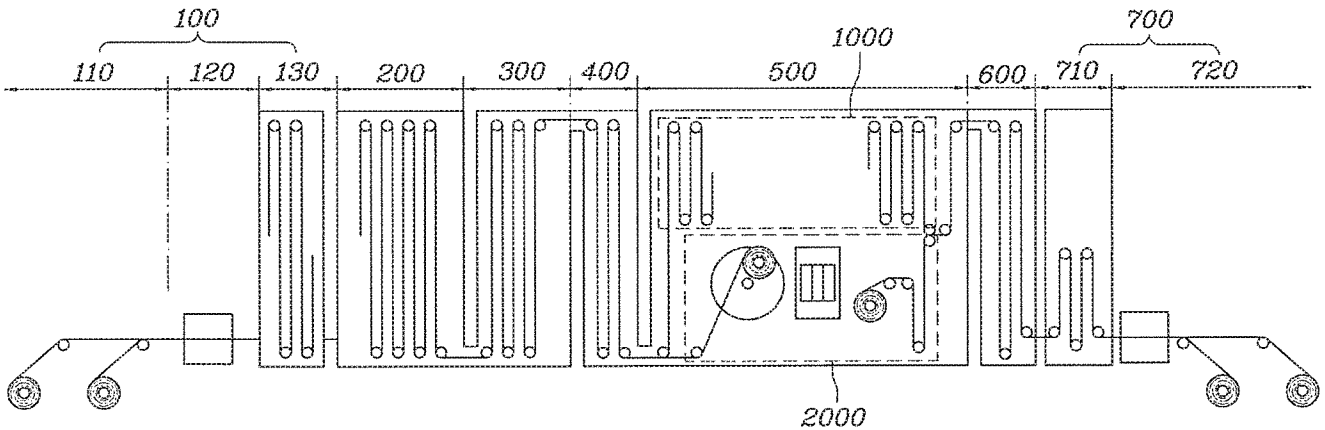
[FIG. 1]

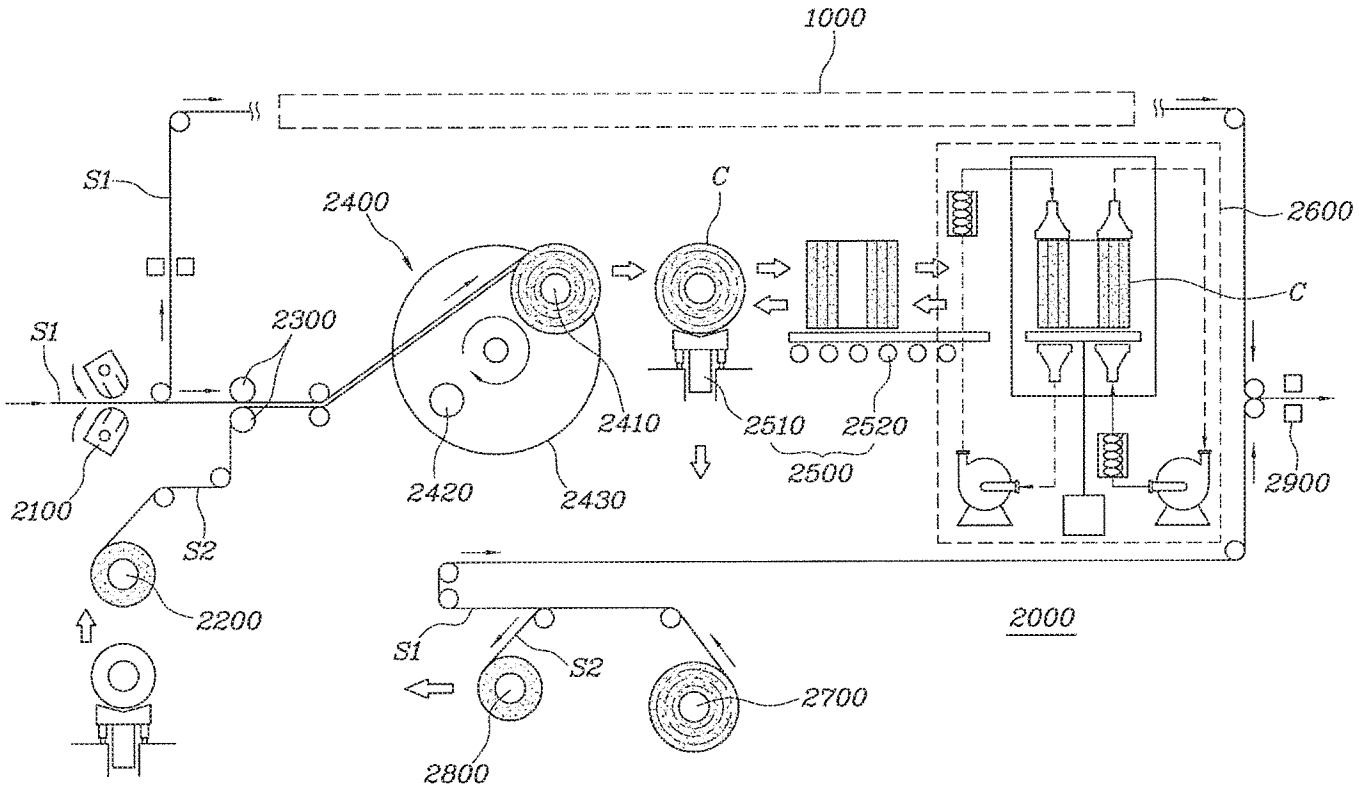
[FIG. 2]

[FIG. 3]
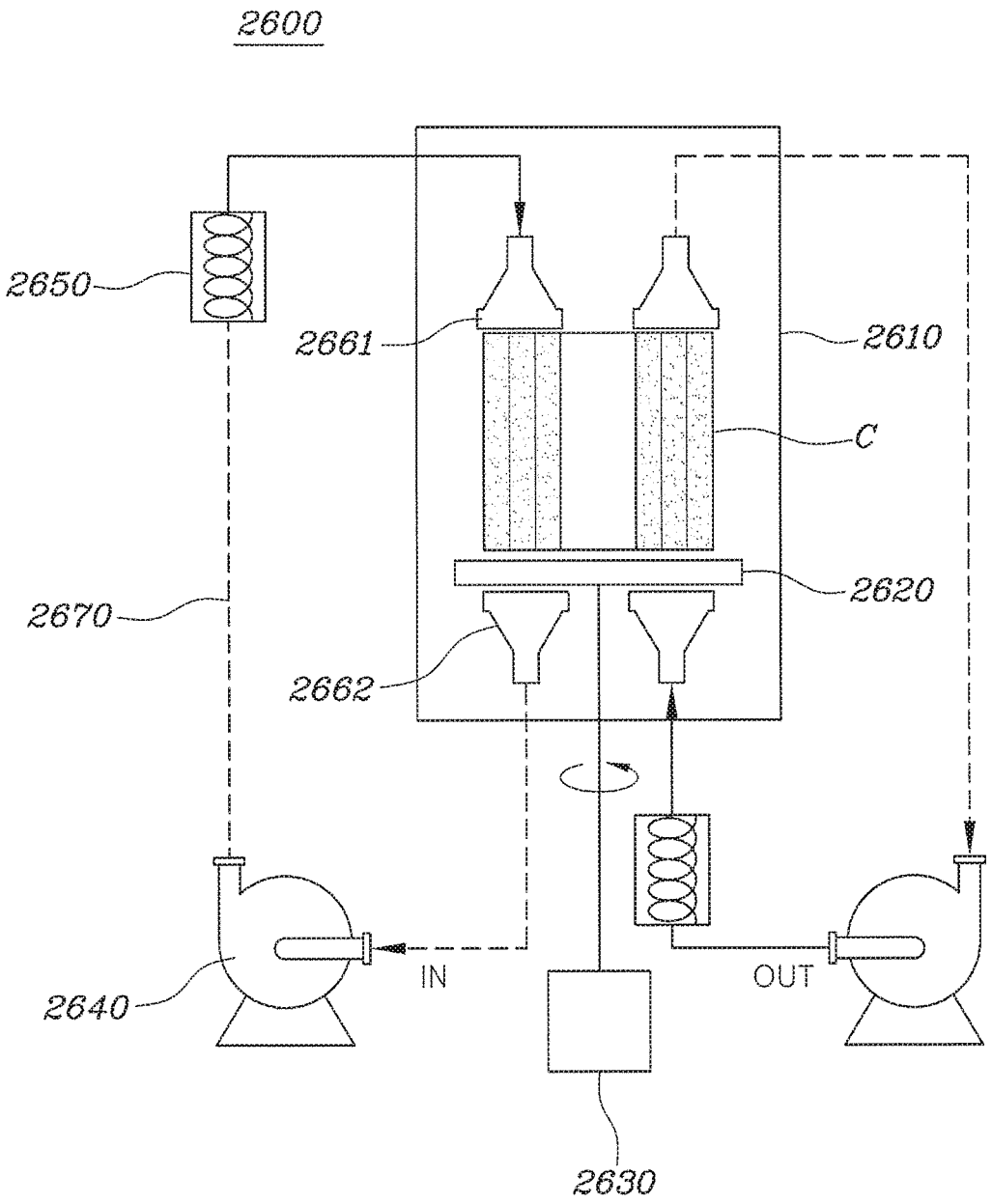

[FIG. 4]
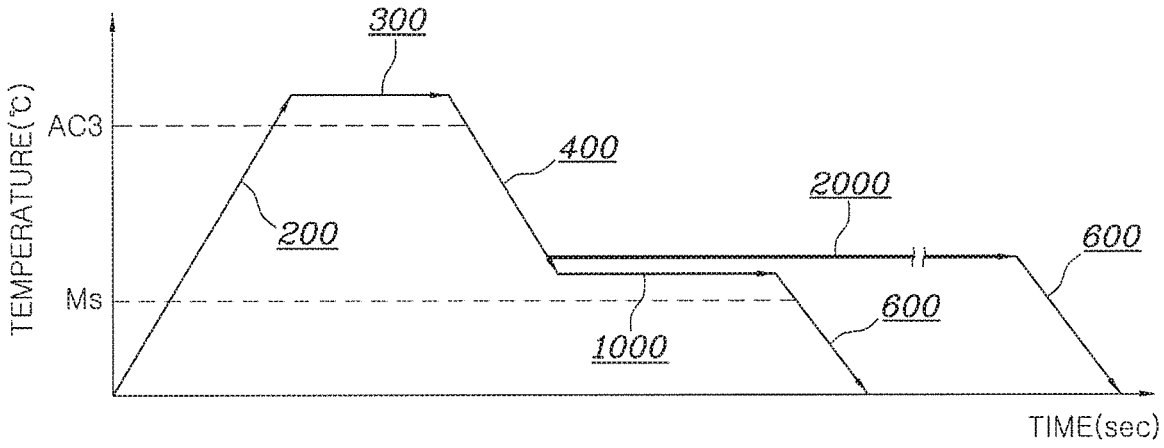

CONTINUOUS ANNEALING APPARATUS

CROSS REFERENCE TO RELATED APPLICATION

The present application claims the benefit of priority of Korean Patent Application No. 10-2017-0094159 filed on Jul. 25, 2017, the entire content of which is incorporated herein for all purposes by this reference.

TECHNICAL FIELD

The present disclosure relates to a continuous annealing apparatus, and more particularly, to a continuous annealing apparatus capable of increasing a holding time in an aging heat treatment section.

BACKGROUND

The physical properties of a cold-rolled steel plate can be improved through various heat treatments.

In recent years, high-toughness steel plates have been used as steel plates for vehicles. Bainitic steel is a representative example of the high-toughness steel plates. The bainitic steel has high strength and ductility, and is thus suitable for non-molded vehicle body parts to increase crash characteristics.

In order to maximize the advantage of the bainitic steel, it is necessary to increase a volume fraction of bainite phase in a fine structure.

Three conditions are known to be satisfied in which i) a carbon content is low, ii) an isothermal transformation temperature is low, and iii) an isothermal transformation temperature holding time is long, in order to increase the volume fraction of bainite phase. Most steel plate manufacturers may apply the conditions i) and ii), whereas it is, in fact, difficult for them to apply the condition iii) due to the limitation of continuous annealing apparatus data. For this reason, the commercial steel plate cannot obtain a maximum expectable effect due to having a low phase fraction of bainite.

The annealing method of the cold-rolled steel plate is largely classified into a continuous annealing line (CAL) type and a batch annealing furnace (BAF) type.

The continuous annealing line type is advantageous in that a steel plate can be uniformly heat treated to thereby have a small physical property variation, rapid heating and cooling can be performed, and it can be maintained at a high temperature of 900° C. or more, but it is disadvantageous in that an isothermal holding time is short.

The batch annealing furnace type is advantageous in that heat treatment can be performed in an isothermal holding state for a long time, but it is disadvantageous in that a variation in temperature between inner and outer diameters of each laminated coil occurs and hence a physical property variation between the coils is wide after heat treatment.

Accordingly, a continuous annealing apparatus, which is capable of strengthening advantages and compensating for heat treatment methods of two continuous annealing line (CAL) type and batch annealing furnace (BAF) type by a combination of these two types, is necessary such that annealing is maintained at high temperature for a long time as occasion demands to manufacture a steel plate with high toughness.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art, and the present disclosure is intended to propose a continuous annealing apparatus capable of strengthening advantages of heat treatment methods of two continuous annealing line (CAL) type and batch annealing furnace (BAF) type by a combination of these two types such that annealing is maintained at high temperature for a short or long time as occasion demands.

In accordance with an aspect of the present disclosure, a continuous annealing apparatus for continuously annealing a strip includes a pre-treatment device to prepare a strip unwound from a coil to continuously anneal the strip, a heating device to heat the strip provided from the pre-treatment device, a heat holding device to isothermally maintain the strip heated by the heating device, a first cooling device to cool the strip provided from the heat holding device, an annealing device including a first annealing device for annealing the strip, which is cooled by the first cooling device, for a first time, and a second annealing device for winding the strip, which is cooled by the first cooling device, into a coil and then unwinding the coil into the strip again after annealing for a second time which is a longer period of time than the first time, the strip provided from the first cooling device being annealed by one of the first annealing device and the second annealing device, a second cooling device to cool the strip annealed by the annealing device, and a post-treatment device to wind the strip cooled by the second cooling device into the coil. The first annealing device may be a continuous annealing line (CAL) type, and the second annealing device may be a batch annealing furnace (BAF) type.

The second annealing device may include a cutting machine to cut the strip provided from the first cooling device into a predetermined length, a continuous coil winding machine to wind each of strips transferred through the cutting machine into a coil, a coil feeding unit to transfer the coil wound by the continuous coil winding machine, a heat treatment unit to anneal the coil for the second time, a main coil unwinding reel to unwind the coil heat-treated by the heat treatment unit into a strip again, and a welding machine to weld preceding and trailing strips unwound from the main coil unwinding reel to each other.

The second annealing device may further include an auxiliary coil unwinding reel to unwind an auxiliary strip wound together with the strip wound by the continuous coil winding machine, a pressure roll to press the auxiliary strip unwound from the auxiliary coil unwinding reel onto one surface of the strip to provide the auxiliary strip to the continuous coil winding machine, and an auxiliary coil winding reel to separate the auxiliary strip from the strip unwound from the main coil unwinding reel to wind the auxiliary strip.

The auxiliary strip may be a porous metal strip.

The continuous coil winding machine may include first and second winding reels about which the strips cut in the predetermined length are wound respectively, and a rotary body in which the first and second winding reels are spaced apart from each other and are alternately arranged at winding positions.

The heat treatment unit may include a heat treatment furnace in which the coil is accommodated, a coil support rotatably disposed in the heat treatment furnace to seat the coil, a motor to provide power for rotating the oil support, first and second gas diffusers disposed in respective upper and lower portions of the coil support to discharge circulation gas to the coil and then suck the circulation gas, a gas pipe connected to the first and second gas diffusers to form a circulation passage for the circulation gas, a pump disposed on the gas pipe for flow of the circulation gas, and a heater disposed on the gas pipe to heat the circulation gas.

As apparent from the above description, in accordance with exemplary embodiments of the present disclosure, since there is provided an apparatus having advantages of a continuous annealing line (CAL) type and a batch annealing furnace (BAF) type, it is possible to hold a heat treatment time for a short period of about several minutes or for a long period of from several hours to several days as occasion demands during annealing of a cold-rolled steel plate.

In addition, it is possible to improve a flow of circulation gas and heat transfer by interposing a porous metal strip as a slip sheet between a strip and another strip while winding a strip into a coil when the annealing is maintained for a long time, and thus to prevent a variation in temperature between inner and outer diameters of the coil from occurring in a batch annealing furnace type annealing apparatus.

BRIEF DESCRIPTION OF THE DRAWINGS

The above and other objects, features and advantages of the present disclosure will be more clearly understood from the following detailed description taken in conjunction with the accompanying drawings, in which:

FIG. 1 is a diagram illustrating a continuous annealing apparatus according to an embodiment of the present disclosure;

FIG. 2 is a diagram illustrating a batch annealing furnace (BAF) type second annealing device according to the embodiment of the present disclosure;

FIG. 3 is a diagram illustrating a heat treatment unit of the second annealing device according to the embodiment of the present disclosure; and FIG. 4 is a graph illustrating a heat treatment cycle during annealing using the continuous annealing apparatus according to the embodiment of the present disclosure.

DESCRIPTION OF PREFERRED EMBODIMENTS

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

FIG. 1 is a diagram illustrating a continuous annealing apparatus according to an embodiment of the present disclosure.

As illustrated in FIG. 1, the continuous annealing apparatus according to the embodiment of the present disclosure includes a pre-treatment device 100, a heating device 200, a heat holding device 300, a first cooling device 400, an annealing device 500, a second cooling device 600, and a post-treatment device 700, which are arranged in this order according to the flow of a steel plate.

The pre-treatment device 100 is a device that prepares a strip by unwinding and annealing a cold-rolled coil, and includes an unwinding reel 110, a welding and degreasing device 120, and an entry-side loop device 130.

The unwinding reel 110 is a means for unwinding a coil, and may use a typical reel. At least two reels are sequentially used to continuously unwind a preceding coil and a trailing coil.

The welding and degreasing device 120 may consist of a welding means for welding and bonding the rear end of the preceding coil to the front end of the trailing coil to continuously supply a strip unwound by the unwinding reel 110, and a degreasing means for electrically removing rolling oil from the surface of the unwound strip.

The entry-side loop device 130 is means for maintaining the tension of the strip and supplying the strip while the movement of the p is stopped, in order to bond the preceding coil to the trailing coil.

The heating device 200 is a device that continuously transfers the room-temperature strip provided from the pre-treatment device and heats it to a predetermined high temperature.

The heat holding device 300 is a device that isothermally maintains the strip, heated to the predetermined high temperature by the heating device 200, at a predetermined temperature for a certain time.

The first cooling device 400 is a device that cools the strip, isothermally maintained by the heat holding device 300, to a predetermined temperature.

The annealing device 500 includes a first annealing device 1000 for annealing a strip for a short time, and a second annealing device 2000 for winding a strip into a coil and then unwinding the coil into the strip again after annealing for a long time, which is a longer period of time than the short time, and serves to anneal the strip provided from the first cooling device 400 by one of the first annealing device 1000 and the second annealing device 2000.

The second cooling device 600 is a device that cools the strip, annealed by the annealing device 500, to room temperature.

The post-treatment device 700 is a device that cuts the strip provided from the second cooling device 600 into a predetermined length and winds it into a coil, and includes an exit-side loop device 710 and a cutting and winding device 720.

The exit-side loop device 710 is a means for maintaining the tension of the strip while cutting the strip, which is cooled by and continuously provided from the second cooling device 600, into a predetermined length.

The cutting and winding device 720 may consist of a cutting means for cutting the continuous strip provided from the exit-side loop device 710 into a predetermined length to obtain a coil having a required weight, and a winding means for winding the strip, cut into the predetermined length, into a coil, wherein at least two reels are sequentially arranged in the winding means.

Since the remaining components, except for the annealing device 500, from among the components included in the continuous annealing apparatus according to the embodiment of the present disclosure may be applied, as they are, to a conventional continuous annealing line (CAL), a detailed description thereof will be omitted. Of course, the remaining components, except for the annealing device 500, from among the components included in the continuous annealing apparatus according to the embodiment of the present disclosure may use various devices applied to the continuous annealing line without limitations. In addition, the remaining components, except for the annealing device 500, from among the components included in the continuous annealing apparatus according to the embodiment of the present disclosure are not limited to the devices applied to the continuous annealing line, but they may use devices applied to a continuous galvanizing line (CGL).

Meanwhile, the annealing device 500 is a main component of the present disclosure, and includes a continuous annealing line (CAL) type first annealing device 1000 for performing annealing for a relatively short time, and a batch annealing furnace (BAF) type second annealing device 2000 for performing annealing for a relatively long time.

The first annealing device 1000 is a means for continuously annealing a strip as it is for a short time, and may continuously anneal a strip for several minutes. Since the first annealing device 1000 may intactly use a device in an annealing section in the conventional continuous annealing line (CAL), a detailed description thereof will be omitted.

The second annealing device 2000 is a means for winding a strip into a coil and then unwinding the coil into the strip again after annealing for a long time, and may anneal the coil for from several hours to several days. Although the second annealing device 2000 adopts a conventional batch annealing furnace (BAF) type, it is improved for continuous annealing.

FIG. 2 is a diagram illustrating the batch annealing furnace (BAF) type second annealing device according to the embodiment of the present disclosure.

As illustrated in FIG. 2, the second annealing device 2000 includes a cutting machine 2100, an auxiliary coil unwinding reel 2200, a pressure roll 2300, a continuous coil winding machine 2400, a coil feeding unit 2500, a heat treatment unit 2600, a main coil unwinding reel 2700, an auxiliary coil winding reel 2800, and a welding machine 2900.

The cutting machine 2100 is a means for cutting strip S1, which is continuously provided from the first cooling device 400, into a predetermined length, and may be a drum-type cutting machine that cuts the strip S1 according to the movement speed of the strip S1 without stopping the strip S1.

The auxiliary coil unwinding reel 2200 is a means for winding the annealed strip S1 and providing an auxiliary strip S2 as a slip sheet interposed between a strip S1 and another strip S1, and unwinds the auxiliary strip S2 to transfer it together with the strip S1 to the pressure roll 2300. In this case, the auxiliary strip S2 uses a metal strip having high thermal conductivity such that heat may be uniformly transferred to the inner and outer diameter portions of a coil C by circulation gas heated while the coil C is annealed in the heat treatment unit 2600. In the present embodiment, auxiliary strip S2 uses a porous copper strip having high thermal conductivity and ventilation.

The pressure roll 2300 is a means for pressing the strip S1 and the auxiliary S2 to a low pressure, and the auxiliary strip S2 is pressed onto one surface of the strip S1 to a low pressure while the strip S1 and the auxiliary strip S2 simultaneously pass between a pair of pressure rolls 2300.

The continuous coil winding machine 2400 is a means for winding the strip S1 and the auxiliary strip S2 together into the coil C, and includes first and second reels 2410 and 2420 arranged to respectively wind a preceding strip and a trailing strip, which are cut and provided, and a rotary body 2430 in which the first and second reels 2410 and 2420 are spaced apart from each other and are alternately arranged at winding positions.

The coil feeding unit 2500 is a unit that transfers the coil C wound by the continuous coil winding machine 2400, and may include a vertical coil transporter 2510 that vertically transfers the coil C, and a coil feeding table 2520 that horizontally transfers the coil C.

FIG. 3 is a diagram illustrating the heat treatment unit of the second annealing device according to the embodiment of the present disclosure.

As illustrated in FIG. 3, the heat treatment unit 2600 is a unit that anneals the transferred coil C for a long time in the batch annealing furnace (BAF) type, and includes a heat treatment furnace 2610, a coil seating device, and circulation gas provision device.

The heat treatment furnace 2610 is a means for providing a space in which the coil C is accommodated and annealed, and includes a cabinet having a door for entrance of the coil C.

The coil seating device is a means for rotating the coil C in a state in which the coil C is accommodated and seated in the heat treatment furnace 2610, and includes a coil support 2620 on which the coil C is seated, and a motor 2630 that provides power for rotating the coil support 2620.

The circulation gas provision device includes first and second gas diffusers 2661 and 2662 that are disposed in respective upper and lower portions of the coil support 2620 to discharge circulation gas to the coil C and then suck it, a gas pipe 2670 that is connected to the first and second gas diffusers 2661 and 2662 to form a circulation passage for the circulation gas, a pump 2640 that is disposed on the gas pipe 2670 so that the circulation gas flows in the gas pipe 2670, and a heater 2650 that is disposed on the gas pipe 2670 to heat the circulation gas.

The main coil unwinding reel 2700 is a means for unwinding the coil C, which is heat-treated by the heat treatment unit 2660, into a strip S1 again.

The auxiliary coal winding reel 2800 is a means for separating the auxiliary strip S2 from the strip S1 unwound from the main coil unwinding reel 2700 to wind the auxiliary W strip S2.

The welding machine 2900 is a means for welding preceding and trailing strips, which are unwound from the main coil unwinding reel 2700, to each other. The welding machine 2900 may also weld the strip annealed by the first annealing device 1000 to the strip annealed by the second annealing device 2000.

Meanwhile, although the means for transferring the strip S1 between the components of the respective devices is not specifically described in the present embodiment, it may be accomplished by arranging a plurality of feed rolls in a transfer path.

The process of annealing the steel plate using the continuous annealing apparatus having the above-mentioned structure according to the embodiment of the present disclosure will be described.

FIG. 4 is a graph illustrating a heat treatment cycle during annealing using the continuous annealing apparatus according to the embodiment of the present disclosure.

The cold-rolled steel plate is wound into a coil, and is then transferred to the pre-treatment device 100. The transferred coil is fitted into a plurality of reels included in the unwinding reel 110, and a strip is alternately unwound from the coil fitted into the plurality of reels so as to be continuously supplied (pay-off reel).

A preceding strip is welded to a trailing strip while the strip unwound by the unwinding reel 110 passes through the welding and degreasing device 120, and cold-rolling oil and foreign substances are removed from the surface of the strip (welding & cleaning).

Meanwhile, the preceding strip does not proceed while the preceding strip is welded to the trailing strip, in which case the strip stored in the entry-side loop device 130 is supplied to the heating device 200, while the strips are welded to each other, so that the strip supplied to the heating device 200 may be continuously supplied (entry loop).

As illustrated in FIG. 4, the welded and degreased strip is heated above a recrystallization temperature while passing through the heating device 200 (heating section). In general, crystallization is performed at a temperature of from Ac1 to Ac3 heated by the heating device 200, or is performed at a temperature of Ac3 or more in a single-phase region of austenite. In this section, a phenomenon, in which the fine structure of the work-hardened strip is changed and the density of dislocation generated by work hardening is low, occurs, namely recovery occurs, and then recrystallization begins so that a polygonal crystal grain having a certain size is shown.

The strip heated above the recrystallization temperature is isothermally maintained for a certain time at the above temperature while passing through the heat holding device 300 (soaking section). In this section, the small crystal grains forming the fine structure of the recrystallized strip grow in size, and they are uniformly distributed while having a fixed size. In this section, a mixture gas (98% nitrogen+2% hydrogen) is used to suppress the surface oxidation of the strip.

After maintained at a high temperature, the strip undergoes a rapid cooling process while passing through the first cooling device 400 (rapid cooling section). In this case, the cooling rate of the strip varies depending on the characteristics of types of steel, but is about from −30° C./s to −100° C./s. The reason for rapid cooling is because cementite ($Fe_3C$), which is in a thermodynamically stable phase, is coarse in a grain boundary during slow cooling at high temperature, thereby adversely affecting mechanical properties. When rapid cooling is performed rather than slow cooling, transgranular supersaturated carbon is precipitated as minute cementite with the consequence that mechanical properties can be stably obtained. In addition, rapid cooling is performed to obtain an austenite phase which is a stable phase at high temperature. In the first cooling device 400, various methods, such as mist-cooling, roll quenching, gas quenching, and water quenching in the form of mist, may be used according to the required cooling rate and surface characteristics.

Meanwhile, a rapid cooling end temperature varies depending on the characteristics of types of steel. The rapid cooling end temperature applied to the vehicle steel plate requiring high toughness is set to be a temperature immediately above or below a martensite starting temperature (Ms) with respect to the Ms. Since martensite transformation does not begin at the temperature immediately above the Ms, all fine structures remain in an austenite phase. On the other hand, at the temperature immediately below the Ms a portion of the fine structures is transformed to be martensite and the remainder remains in an austenite phase.

The strip passing through the first cooling device 400 enters the annealing device 500. In this section, the strip may selectively pass through the first annealing device 1000 for typical over-aging heat treatment and the second annealing device 2000 for allowing isothermal holding for a long time (dual over-aging section).

The over-aging heat treatment in the first annealing device 1000 may be maintained at a predetermined temperature for about several minutes since the length of the heat treatment furnace is restrictive.

Meanwhile, the isothermal holding heat treatment may be performed for from several hours to several days in the second annealing device 2000. In the section of the second annealing device 2000, different types of steel may be heat-treated at the same time at a different temperature from the first annealing device 1000. In particular, it is possible to obtain ideal mechanical properties of types of steel such as bainite/qnp/tempered martensite steel, which are obtained only through carbon diffusion and non-diffusion transformation processes at a temperature immediately above or below the Ms for a long time.

The annealed strip is rapidly cooled while passing through the second cooling device 600 in order to prevent precipitation of cementite, which may additionally occur in a grain boundary, and cool the cementite to room temperature (fast cooling section).

The strip passing through the second cooling device 600 moves to the exit-side loop device 710 (exit loop). Next, the strip passing through the exit-side loop device 710 is cut and wound into a coil by the cutting and winding device 720 (coil cutting & tension reel).

The strip is stopped while it passes through the exit-side loop device 710 and is then cut. For this time, the strip supplied from the second cooling device 600 is stored in the exit-side loop device 710.

The heat treatment process of the annealing device will be described in detail.

The strip transferred to the annealing device 500 enters a selected one of the first annealing device 1000 and the second annealing device 2000.

First, when the strip enters the first annealing device 1000, the strip S1 moves to a typical over-aging heat treatment section by a deflector roll. In the over-aging heat treatment section, the strip is heat-treated by exposure to a heat transfer environment by convection while passing between a heated radian heating tube and another tube. Since the heat treatment section of the first annealing device 1000 have a finite length, heat treatment can be isothermally performed for several minutes, e.g. for about five minutes.

Next, when the strip enters the second annealing device 2000, the strip S1 is cut while passing through the cutting machine 2100. The cut strip moves to the pressure roll 2300.

In this case, the auxiliary strip S2 is unwound from the auxiliary coil unwinding reel 2200, and is transferred together with the strip S1 to the pressure roll 2300.

The strip S1 and auxiliary strip S2 transferred to the pressure roll 2300 are pressed to a low pressure by the pressure roll 2300.

The strip S1 and auxiliary strip S2 passing through the pressure roll 2300 are alternately wound about the first or second reel 2410 or 2420 of the continuous coil winding machine 2400 in a pressed state.

The coil C wound about the first or second reel 2410 or 2420 is transferred to the vertical coil transporter 2510.

The coil C transferred to the vertical coil transporter 2510 is changed again in posture, and is transferred to the coil feeding table 2520 to be inserted into the heat treatment unit 2600.

The coil C is inserted into the heat treatment furnace 2610 and is seated on the coil support 2620. In this case, the coil support 2620 is connected to the motor 2630 so as to be rotatable by an angle of 360°. When the coil C is seated, the first and second gas diffusers 2661 and 2662 are disposed on the upper and lower surfaces of the coil C. Then, the circulation gas heated by the heater 2650 is discharged to the coil C through the first gas diffuser 2661. The second gas diffuser 2662 sucks the circulation gas Through such an operation, the circulation gas is circulated while passing through the coil C for heat treatment.

In this case, with respect to the center of the coil C, one side of the first gas diffuser 2661 is disposed on the upper portion of the coil C and the other side of the first gas diffuser 2661 is disposed on the lower portion of the coil C. Similarly, with respect to the center of the coil C, one side of the second gas diffuser 2662 is disposed on the lower portion, of the coil C and the other side of the second gas diffuser 2662 is disposed on the upper portion of the coil C. Thus, the gas is circulated in the left and right directions, i.e. in the clockwise direction with respect to the center of the coil C. In this case, since the coil C seated on the coil support 2520 is rotated by the operation of the motor 2630, the circulation gas in the coil C is not circulated in one direction, but is circulated in a spiral form. The circulation of gas in the spiral form allows uniform movement of temperature to a coil width, and may therefore minimize a variation in temperature between inner and outer diameters.

In particular, since the porous auxiliary strip S2 having high thermal conductivity is interposed between a strip S1 and another strip S1, it is possible to obtain high ventilation of circulation gas in the coil C and perform isothermal holding heat treatment of the coil C by uniform heat transfer. This heat treatment method can perform isothermal holding heat treatment for a long time unlike the annealing device 1000, and minimize a variation in temperature in the coil C. Therefore, it is possible to expect uniform mechanical properties obtained after heat treatment.

The heat-treated coil C is transferred to the main coil unwinding reel 2700 and is then unwound.

The auxiliary strip S2 is separated from the strip S2 unwound from the isothermal holding heat treatment, and is wound about the auxiliary coil winding reel 2600.

Meanwhile, the strip S1, from which the auxiliary strip S2 is separated, is provided to the second cooling device 600 after the preceding and trailing strips are welded to each other by the welding machine 2900.

Since the annealing device 500 performs heat treatment by selective pass of the first or second annealing device 1000 or 2000, it is possible to maintain the annealing holding time for a desired time, as illustrated in FIG. 4.

Although the preferred embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. A continuous annealing apparatus for continuously annealing a strip, the continuous annealing apparatus comprising:

a pre-treatment device to prepare a strip unwound from a coil to continuously anneal the strip;

a heating device to heat the strip prepared by the pre-treatment device;

a heat holding device to isothermally maintain the strip heated by the heating device;

a first cooling device to cool the strip heat maintained by the heat holding device;

an annealing device comprising:

a first annealing device disposed adjacent to a side of the first cooling device and annealing the strip, which is cooled by the first cooling device, for a first time; and a second annealing device disposed adjacent to the side of the first cooling device and winding the strip, which is cooled by the first cooling device, into a coil and then unwinding the coil into the strip again after annealing for a second time which is a longer period of time than the first time;

a second cooling device to cool the strip annealed by the first annealing device or the second annealing device; and a post-treatment device to wind the strip cooled by the second cooling device into the coil, wherein the second annealing device comprises:

a cutting machine to cut the strip cooled by the first cooling device into a predetermined length;

a continuous coil winding machine to wind each of strips transferred through the cutting machine into a coil;

a coil feeding device to transfer the coil wound by the continuous coil winding machine;

a heat treatment device to anneal the coil for the second time;

a main coil unwinding reel to unwind the coil heat-treated by the heat treatment device into a strip again; and a welding machine to weld preceding and trailing strips unwound from the main coil unwinding reel to each other.

2. The continuous annealing apparatus according to claim 1, wherein the first annealing, device of the annealing device is a continuous annealing line (CAL), and the second annealing device is a batch annealing furnace (BAF).

3. The continuous annealing apparatus according to claim 1, wherein the second annealing device further comprises:

an auxiliary coil unwinding reel to unwind an auxiliary strip wound together with the strip wound by the continuous coil winding machine;

a pressure roll to press the auxiliary strip unwound from the auxiliary coil unwinding reel onto one surface of the strip to transfer the auxiliary strip to the continuous coil winding machine; and an auxiliary coil winding reel to separate the auxiliary strip from the strip unwound from the main coil unwinding reel to wind the auxiliary strip.

4. The continuous annealing apparatus according to claim 3, wherein the auxiliary strip is a porous metal strip.

5. The continuous annealing apparatus according to claim 1, wherein the continuous coil winding machine comprises:

first and second winding reels on which the strips cut in the predetermined length are wound respectively; and a rotary body in which the first and second winding reels are spaced apart from each other and are alternately arranged at winding positions.

6. The continuous annealing apparatus according to claim 1, wherein the heat treatment device comprises:

a heat treatment furnace in which the coil is accommodated;

a coil support rotatably disposed in the heat treatment furnace to seat the coil;

a motor generating power for rotating the coil support;

first and second gas, diffusers disposed in respective upper and lower portions of the coil support to discharge circulation gas to the coil and then suck the circulation gas;

a gas pipe connected to the first and second gas diffusers to form a circulation passage for the circulation gas;

a pump disposed on the gas pipe for flow of the circulation gas; and a heater disposed on the gas pipe to heat the circulation gas.

* * * * *